US005704829A

United States Patent [19]

Long

[11] Patent Number: 5,704,829

[45] Date of Patent: Jan. 6, 1998

[54] HAND-HELD SKATE BLADE EDGE DEBURRING TOOL

[76] Inventor: Jim Long, 10 Woodside Rd., Durham, N.H. 03824

[21] Appl. No.: 740,840

[22] Filed: Nov. 4, 1996

[51] Int. Cl.[6] ..... B23F 21/03

[52] U.S. Cl. ..... 451/558; 451/321; 451/356; 451/383

[58] Field of Search ..... 457/356, 558, 457/383, 321; 76/83, 88

[56] References Cited

U.S. PATENT DOCUMENTS

| | | | |
|---|---|---|---|
| 1,441,499 | 1/1923 | Hanlon | 451/558 |
| 4,219,975 | 9/1980 | Scholler | 451/558 |
| 4,815,240 | 3/1989 | Larson . | |
| 4,908,994 | 3/1990 | Fraser . | |
| 5,193,315 | 3/1993 | Martinez | 451/557 |
| 5,291,805 | 3/1994 | Byers et al. . | |
| 5,383,307 | 1/1995 | Anderson . | |
| 5,445,050 | 8/1995 | Owens | 451/558 |
| 5,499,556 | 3/1996 | Exner et al. | 451/558 |
| 5,569,064 | 10/1996 | Gleadall et al. | 451/558 |

OTHER PUBLICATIONS

Quick Edge™ Two page document Copyright 1993 –Hand Held Disposable Skate Sharpener, Warminster, PA.

*Primary Examiner*—Robert A. Rose
*Assistant Examiner*—George Nguyen
*Attorney, Agent, or Firm*—Howson and Howson

[57] ABSTRACT

A compact, hand-held tool for safely deburring the edges of a skate blade. The tool utilizes a pair of resiliently biased deburring surfaces which are movable between an open position and a closed position. The deburring surfaces are resiliently biased in the open position by a biasing means such as a leaf spring. In the open position, any size or shape skate blade can be readily inserted between the deburring surfaces. A user can apply pressure between his/her thumb and fingers to engage the deburring surfaces against the skate blade edges. The width of the skate blade determines the extent of the closed position. In the closed position the tool can be manipulated back and forth along the length of the skate blade to simultaneously deburr both edges.

16 Claims, 3 Drawing Sheets

FIG. 1
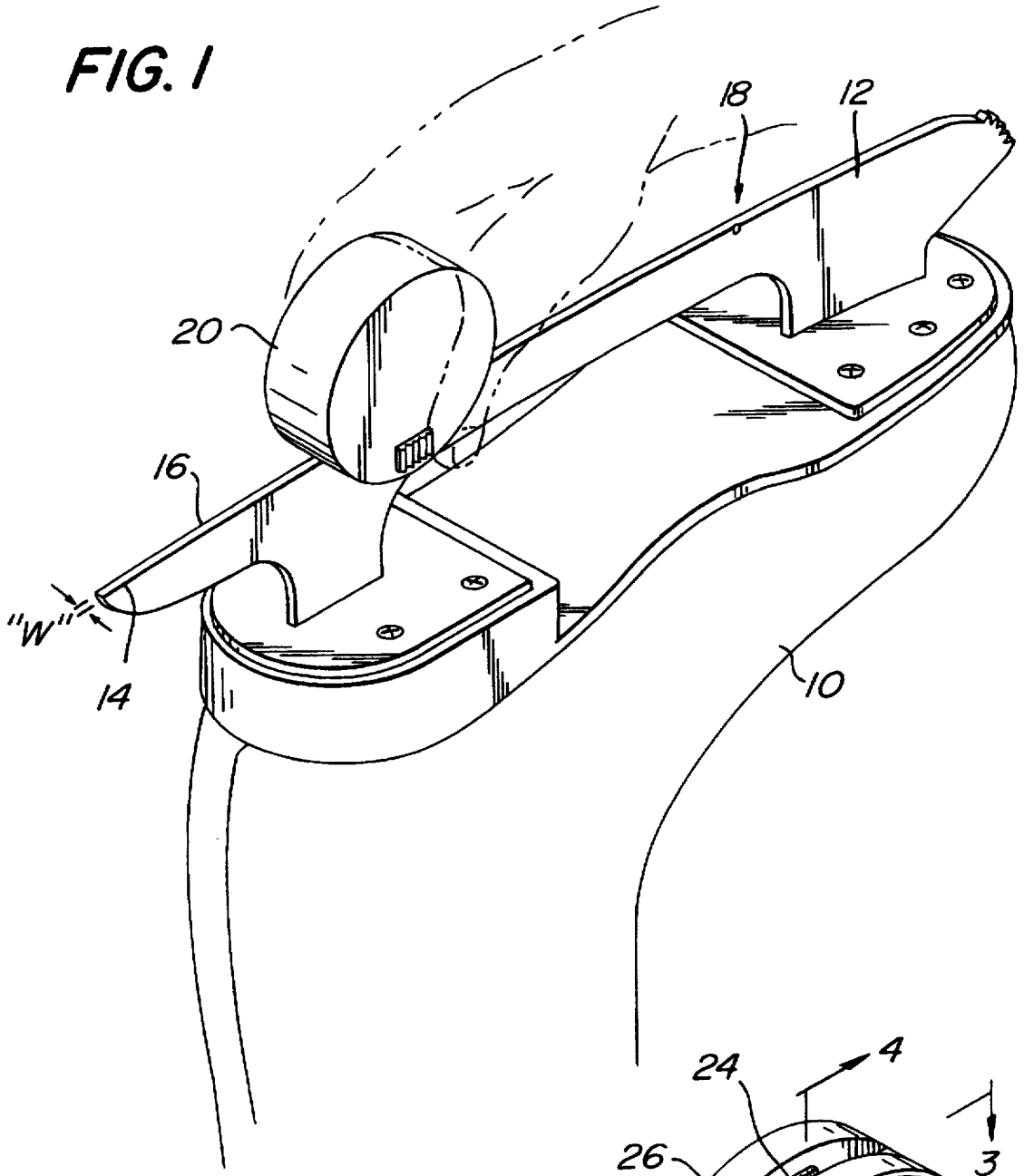
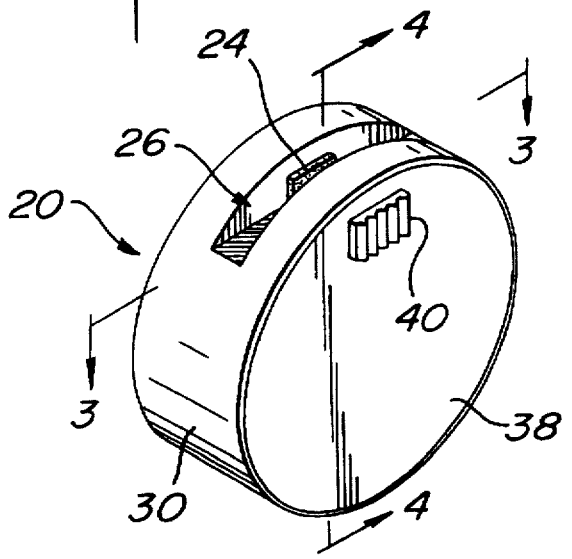
FIG. 2

FIG. 3
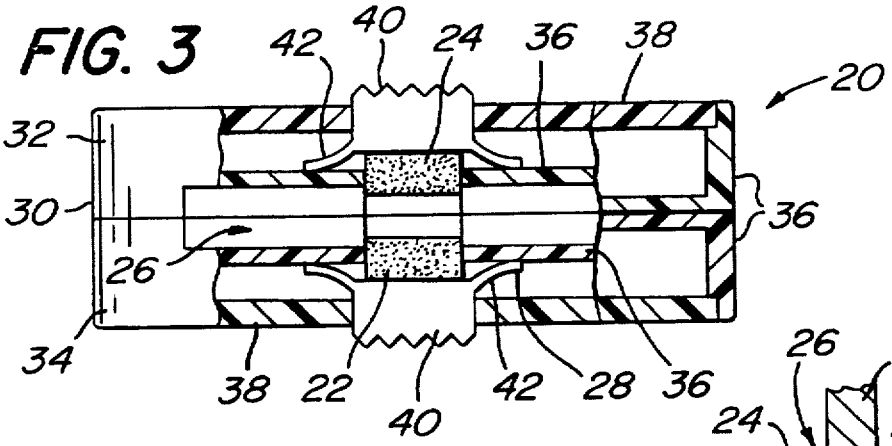
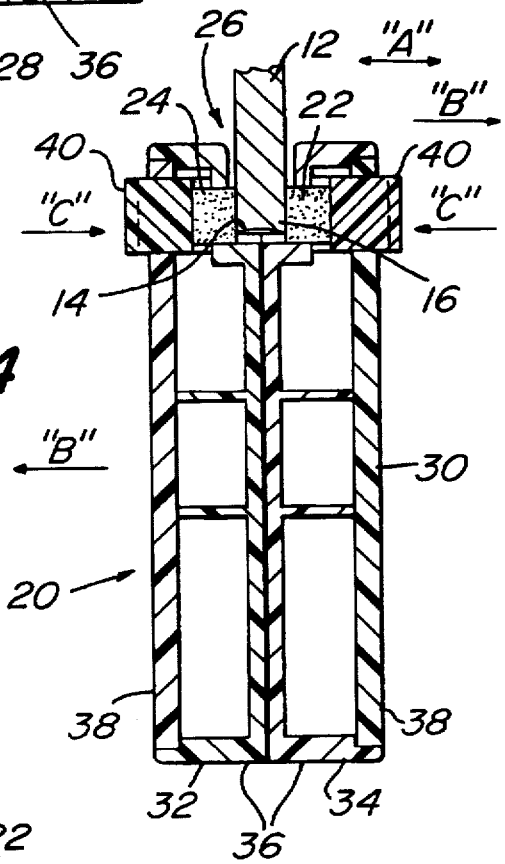
FIG. 4
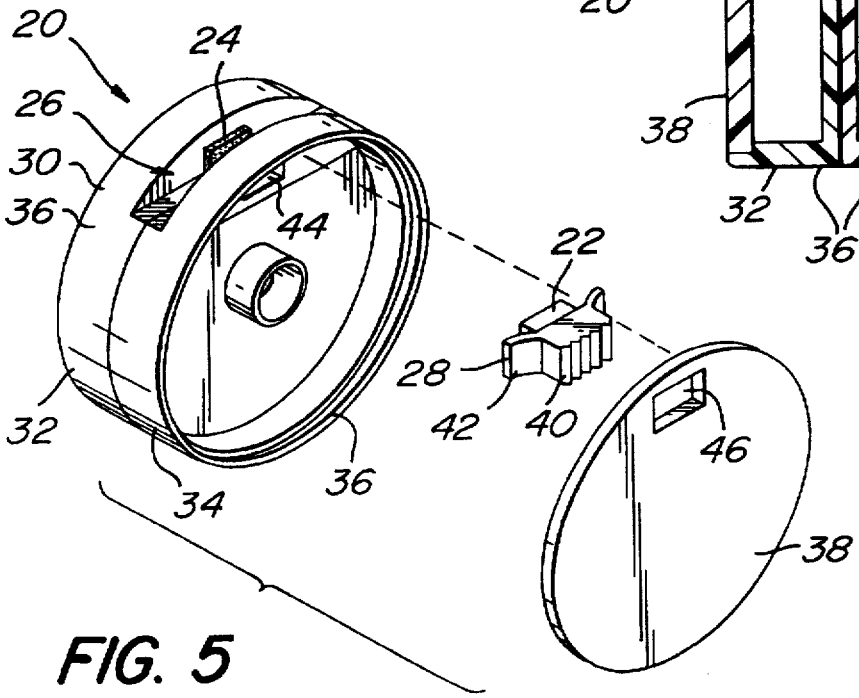
FIG. 5

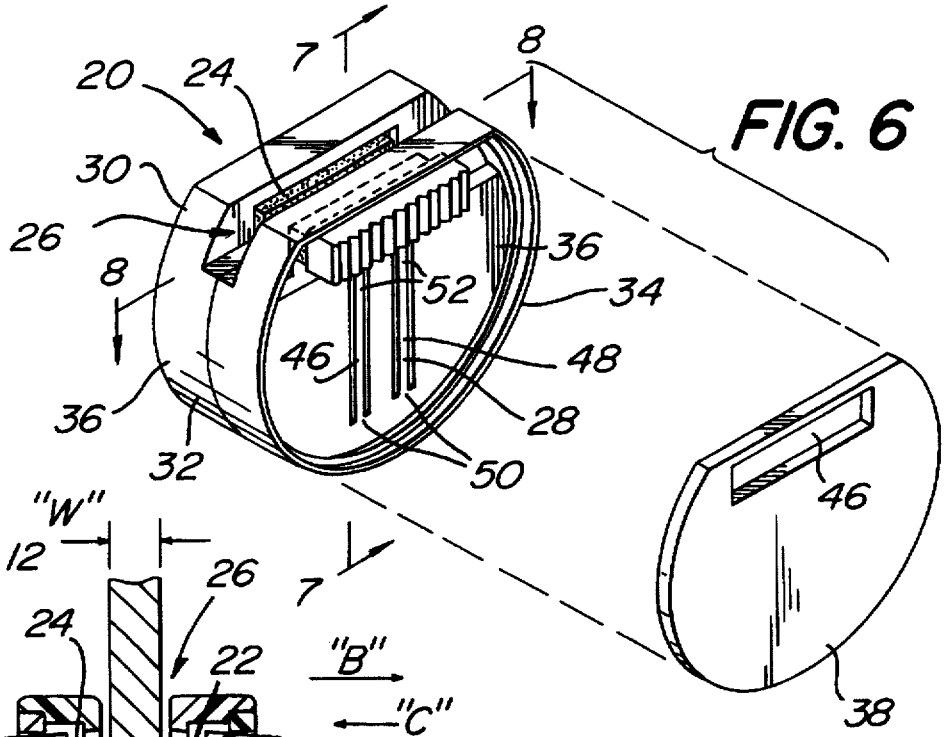
FIG. 6
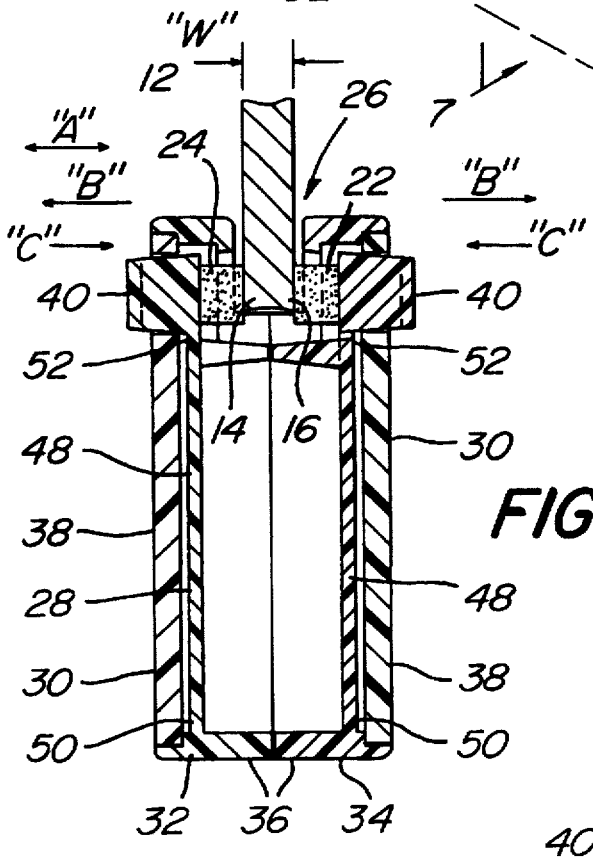
FIG. 7
FIG. 8
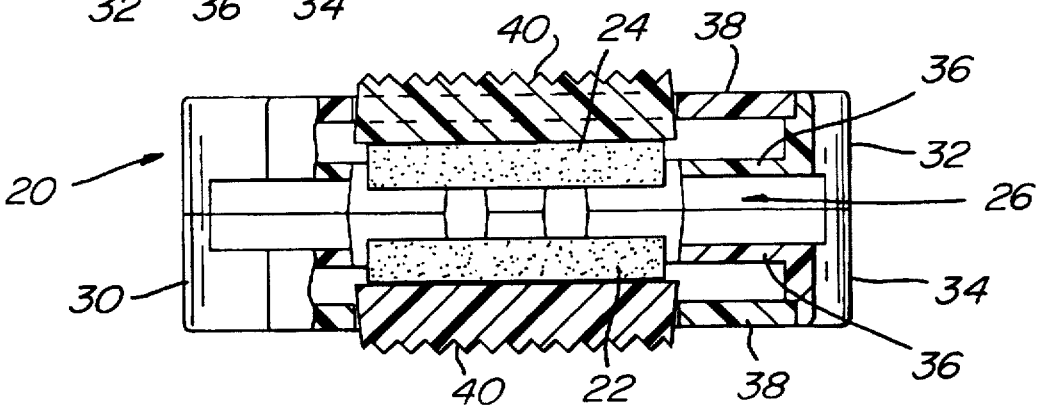

HAND-HELD SKATE BLADE EDGE DEBURRING TOOL

FIELD OF THE INVENTION

The present invention relates to a hand-held tool for deburring the edges of an ice skate blade, and more particularly, the present invention relates to a deburring tool capable of simultaneously deburring both edges of a skate blade and capable of use on different skate blades having different widths.

BACKGROUND OF THE INVENTION

The conventional ice skate has a blade with an edge, or edges, for contacting the ice surface. The edges should be straight and parallel to maximize performance.

A common problem experienced by ice skaters is that one, or both, of the edges can become nicked, or dented, by a foreign object resulting in a peened over edge. The foreign object could be, for instance, another skate blade or a hockey stick. The peened over edge reduces the performance of the skate.

The conventional solution to this problem is to utilize a single whet-stone to displace the burr on the skate. The whet-stone is held directly in the skater's hand, maintained under pressure against one of the blade edges, and manipulated back and forth along the length of the blade. This deburring technique often results in skinned knuckles because it is difficult to apply the required pressure and maintain proper positioning of the whet-stone on the blade.

Other tools have attempted to address the need for ready deburring of a skate blade edge. U.S. Pat. No. 4,815,240 issued to Larson discloses a hand-held tool for sharpening and deburring a skate blade. The deburring portion of the Larson tool provides a slot defined on one side by a deburring surface and on the other side by a plastic housing. A skate blade is intended to be received in the slot and the deburring surface is engaged with one edge of the skate under tension by the user's hand. The tool is moved back and forth across the length of the blade to deburr one side of the blade edge. The skate blade is then removed from the slot and replaced in a reversed position to deburr the opposite edge of the blade.

Another skate edge deburring and sharpening tool is sold under the trademark QUICK-EDGE. This tool has a center stone which is applied with pressure against the bottom of the skate blade. After a portion of the center stone is sufficiently worn away, the center stone contours to the shape of a particular skate blade and can be used to deburr the skate blade edges. Each individual tool is recommended for use with only a single pair of skates since skate blade dimensions and shapes vary greatly from one pair of skates to the next.

U.S. Pat. Nos. 5,383,307, 4,219,975 and 4,908,994 disclose other hand-held tools capable of manipulation on a skate blade.

Although the various referenced skate-related tools may function satisfactorily for their intended purposes, there is a need for a hand-held skate blade deburring tool which can be readily, and safely, used by a skater to quickly deburr a nicked skate edge. The tool should be small so that it is readily accessible to the skater and should be capable of use on any number of skate blades despite the differences in size or shape of the skate blades. The tool should be capable of inexpensive manufacture to provide consumers with an inexpensive, readily available and effective tool for deburring a skate blade edge.

OBJECTS OF THE INVENTION

With the foregoing in mind, a primary object of the present invention is to provide a hand-held tool for deburring the edges of an ice skate blade in a safe manner which reduces the risk of skinned knuckles.

Another object of the present invention is to provide a means of properly deburring skate edges which aids in preventing the skater from further damaging his/her skate blades edges.

A further object of the present invention is to provide a hand-held tool which can readily and effectively be used to simultaneously deburr both skate edges.

A further object is to provide a single hand-held deburring tool which readily adapts for use on any number of skate blades despite the differences between the skate blade dimensions and shapes.

A still further object is to provide an inexpensive deburring tool which is small enough in size to fit in a skater's pocket so that it is readily available to the skater or his/her colleagues.

SUMMARY OF THE INVENTION

The present invention provides a hand-held tool for simultaneously deburring both edges of an ice skate blade which can be used on any number of skate blades despite their different sizes or shapes. The tool has a pair of juxtaposed deburring surfaces which are maintained in a spaced relation and which define a slot to receive the ice skate blade. The tool also has means for biasing at least one, or both, of the deburring surfaces under pressure toward the other deburring surface so that the deburring surfaces engage opposite edges of the skate blade to simultaneously deburr both edges of the skate blade. When no hand pressure is applied, the biasing means resiliently biases at least one of the deburring surfaces in a direction away from the other deburring surface so that any size skate blade is readily received in, and removed from, the slot.

BRIEF DESCRIPTION OF THE DRAWINGS

The foregoing and other objects, features and advantages of the present invention should become apparent from the following description when taken in conjunction with the accompanying drawings, in which:

FIG. 1 is a perspective view of an ice skate and a hand-held deburring tool embodying the present invention;

FIG. 2 is a perspective view of a hand-held deburring tool embodying the present invention;

FIG. 3 is a cross-sectional view of the hand-held deburring tool taken along line 3—3 of FIG. 2;

FIG. 4 is a cross-sectional view of the hand-held deburring tool taken along line 4—4 of FIG. 2;

FIG. 5 is an exploded perspective view of a hand-held deburring tool embodying the present invention;

FIG. 6 is an exploded perspective view of an alternate embodiment of a hand-held deburring tool according to the present invention;

FIG. 7 is a cross-sectional view of the hand-held deburring tool taken along line 7—7 of FIG. 6; and FIG. 8 is a cross-sectional view of the hand-held deburring tool taken along line 8—8 of FIG. 6.

DETAILED DESCRIPTION OF THE PREFERRED EMBODIMENT

As illustrated in FIG. 1, an ice skate 10 has a skate blade 12 with edges 14 and 16. The skate blade 12 has a width "W"

which typically ranges in size from about ⅛ inch to about ¼ inches. Through normal use of the ice skate 10, it is common for the skate blade 12 to develop, for instance, a nick or burr 18 in one, or both, of the edges, 14 and 16. The burr 18 could be the result of the skate blade 12 contacting another skate blade (not shown), a hockey stick (not shown), a bench pole (not shown) or any other object that would cause damage to the skate blade 12.

According to the present invention, a tool 20 having a pair of juxtaposed deburring surfaces, 22 and 24, can be used to deburr the edges, 14 and 16, of the skate blade 12. To this end, the tool 20 has a slot 26 defined by the deburring surfaces, 22 and 24, which receives the skate blade 12, including the edges 14 and 16, and is manipulated back and forth along the length of the skate blade 12. As the tool 20 is being manipulated back and forth, the user applies hand pressure to engage the deburring surfaces, 22 and 24, against the edges, 14 and 16. As shown in FIG. 1, the tension is applied by the thumb and fingers of the user.

The novel aspects of the present invention include the capability of a single tool to simultaneously deburr both edges, 14 and 16, of the skate blade 12 and the capability of a single tool to deburr any number of skate blades 12 regardless of shape or size. To accomplish these goals, the tool 20 has a means 28 for biasing at least one of the deburring surfaces, 22 and/or 24, in a direction "A" transverse to the other deburring surface, 22 or 24. Thus, the deburring surfaces, 22 and 24, can be manipulated into a closed position to tightly engage the edges, 14 and 16, of the skate blade 12, or into an open position to allow ready insertion or removal of any size or shape skate blade without causing further damage to the skate blade edges.

The tool 20 according to the present invention is inexpensive to manufacture, is small enough to fit in a skater's pocket or gym bag, and can be used safely. To this end, the tool 20 has a hockey puck-shaped plastic housing 30 which, as shown in FIG. 1, protects the users hand from coming into contact with the edges, 14 and 16, of the skate blade 12. The housing 30 is made from two identical, juxtaposed sections, 32 and 34. Each section, 32 and 34, is formed from an inner part 36 and an outer circular end wall 38. Each housing section, 32 and 34, forms part of the slot 26 and houses one of the deburring surfaces, 22 or 24, and the biasing means 28.

A first embodiment of a biasing means 28, illustrated in FIGS. 1–5, comprises a push-button 40 having a pair of integrally formed, laterally extending, curved-shaped leaf springs 42. Each deburring surface, 22 and 24, is mounted on the slot-facing-side of one of the push-buttons 40, and each deburring surface/push-button/leaf spring combination is captured within one of the housing sections, 32 and 34. Each housing section, 32 and 34, has an aperture 44 leading into the slot 26 and an aperture 46 in the outer end wall 38. The deburring surfaces, 22 and 24, extend through, or partially through, the apertures 44, and the push-buttons 40 extend through, or partially through, the apertures 46.

The leaf springs 42 are captured within the housing sections, 32 and 34, and resiliently bias the push-buttons 40 and deburring surfaces, 22 and 24, in a direction "B" away from the slot 26, and thus, in an open position. See FIG. 3. However, under hand pressure generated between the thumb and fingers of the user, the push-buttons 40 and the deburring surfaces, 22 and 24, can be urged in a direction "C" toward the slot 26 to engage the deburring surfaces 22 and 24 under tension against the edges, 14 and 16, of the skate blade 12 positioned in the slot 26. See FIG. 4. Thus, the deburring surfaces, 22 and 24, must be in the closed position to deburr the edges, 14 and 16. However, the width of the skate blade 12 defines the extent of the closed position which allows the tool 20 to deburr differently sized and shaped skate blades.

A second embodiment of a biasing means 28 is illustrated in FIGS. 6–8. Each inner part 36 of the housing sections, 32 and 34, have integral leaf springs 48 formed from cut-away portions of the inner part 36. Each leaf spring 48 has a hinged portion 50 connecting the leaf spring 48 to the inner part 36 and a free end portion 52 remote from the hinged portion 50. Each pair of push-buttons 40 and deburring surfaces, 22 and 24, are connected to the free end portion 52 of the leaf springs 48 on one of the housing sections, 32 and 34.

When no pressure is being applied to the push-buttons 40, the deburring surfaces, 22 and 24, are resiliently biased by the leaf springs 48 into an open position. Under no hand pressure, the leaf springs 48 extend into the plane of the surrounding inner part 36 from which it was cut. Thus, as shown in FIG. 8, any size or shape skate blade could be positioned between the deburring surfaces, 22 and 24.

As illustrated in FIG. 7, pressure can be exerted against push-buttons 40 to move the deburring surfaces, 22 and 24, further into the slot 26 the necessary distance to engage the edges, 14 and 16, of the skate blade 12. In this closed position, the deburring surfaces can simultaneously deburr both edges of the skate blade. The width of the skate blade 12 determines the extent to which the deburring surfaces, 22 and 24, need to be advanced into the slot 26.

The use of leaf springs, for example 42 and 48 as disclosed above, as the biasing means 28 is preferred based on their inexpensive manufacture. The leaf springs can be integral with the push-buttons or the housing, or they can be completely separate and merely retained within the housing. In addition, other biasing means 28 are within the scope of the invention. For instance, metal coil springs, non-metal coil springs, compressible rubber-like material, or shaped memory alloys could also be used as well as other known equivalent resilient biasing elements.

The deburring surfaces, 22 and 24, are preferably whetstones, but they could be any other known deburring element. The pair of whet-stones are preferably juxtaposed in a spaced parallel relation. The whet-stones, push-buttons 40, and apertures 44 and 46 can be any size or shape as long as both edges, 14 and 16, of the skate blade 12 can be simultaneously deburred.

The shape of the tool 20 can vary, however, it is preferably of a small size so that it is readily available to the skater before, during, or after a skating event.

The described deburring tool 20 provides a tool for effectively and simultaneously deburring both edges of the skate blade. The same tool 20 can be used on different pairs of skates regardless of the different size and shape between the skate blades. By way of example, and not by way of limitation, the tool 20 can accommodate blade widths of about ⅛ to about ¼ inches. The tool 20 can be used in a safe manner without risk of injury to the user's hand and can be readily available to the skater based on its small size and inexpensive cost.

While a preferred skate blade edge deburring tool has been described in detail, various modifications, alterations, and changes may be made without departing from the spirit and scope of the present invention as defined in the appended claims.

We claim:

1. A hand-held tool for deburring the edges of an ice skate blade, comprising:

a pair of juxtaposed deburring surfaces which are maintained in a spaced relation and which define a slot of sufficient width to readily receive a skate blade which has a blade width within a range of sizes; and means for biasing at least one of said deburring surfaces under pressure toward said other deburring surface so that said deburring surfaces simultaneously engage opposite edges of the skate blade to simultaneously deburr both edges of the skate blade;

wherein said biasing means resiliently biases at least one of said deburring surfaces in a direction away from said other deburring surface when not under pressure so that different sized skate blades are readily received in, and removed from, said slot; and wherein said biasing means includes at least one leaf spring to resiliently bias at least one of said deburring surfaces.

2. A hand held tool according to claim 1, wherein said pair of deburring surfaces and said biasing means are retained in a plastic housing.

3. A hand-held tool according to claim 2, wherein each of said deburring surfaces is a whet-stone.

4. A hand-held tool according to claim 3, wherein said biasing means includes at least one push-button which has one of said whet-stones mounted thereon.

5. A hand-held tool according to claim 4, wherein said at least one leaf spring is integrally formed on said at least one push-button.

6. A hand-held tool according to claim 4, wherein said at least one leaf spring is integrally formed on said housing.

7. A hand-held deburring tool for deburring the edges of a skate blade having a blade width within a range of sizes, comprising:

a housing; and a pair of deburring surfaces juxtaposed in a spaced relation in said housing such that said pair of deburring surfaces and said housing define a slot to receive the skate blade therein;

said pair of deburring surfaces are movable into an open position such that the skate blade can be readily placed in, and removed from, said slot;

said pair of deburring surfaces are moveable into a closed position such that each of said deburring surfaces are engagable under pressure to opposite edges of the skate blade;

said deburring surfaces are resiliently biased in said open position; and wherein each of said deburring surfaces are resiliently biased by at least one leaf spring;

whereby in said closed position the hand-held deburring tool can be moved back and forth along the length of the skate blade to simultaneously deburr both skate blade edges.

8. A hand-held deburring tool according to claim 7, wherein each of said deburring surfaces is a whet-stone and each of said whet-stones are mounted on push-buttons which can be engaged between a user's thumb and fingers.

9. A hand-held deburring tool according to claim 8, wherein each of said push-buttons has a pair of leaf springs formed integrally therewith.

10. A hand-held deburring tool according to claim 8, wherein a pair of leaf springs are formed integral with said housing.

11. A hand-held skate blade edge deburring tool capable of deburring different sized skate blades, comprising a housing;

a pair of deburring surfaces retained in a spaced parallel relation by said housing such that at least one of said deburring surfaces is movable in a direction transverse to said other deburring surface, said deburring surfaces and said housing define a slot to receive the skate blade such that each of said deburring surfaces are engagable with an opposite edge of the skate blade; and at least one leaf spring located within said housing for resiliently biasing said at least one movable deburring surface in said direction away from said other deburring surface so that the skate blade is readily received in and removed from said slot;

whereby said at least one moveable deburring surface can be displaced under finger pressure toward said other deburring surface to apply tension against both skate blade edges for simultaneously deburring both edges.

12. A hand-held skate blade edge deburring tool according to claim 11, wherein both of said deburring surfaces are movable in said transverse direction.

13. A hand-held skate blade edge deburring tool according to claim 12, wherein each of said deburring surfaces is resiliently biased by a pair of leaf springs.

14. A hand-held skate blade edge deburring tool according to claim 13, further comprising a pair of buttons oppositely located on said housing, each button having mounted thereon one of said deburring surfaces, and each button connected to one of said pair of leaf springs, whereby a user can apply finger pressure to said buttons to force said deburring surfaces to simultaneously engage the edges of the skate blade.

15. A hand-held skate blade edge deburring tool according to claim 14, wherein said leaf springs are formed integrally on said buttons.

16. A hand-held skate blade edge deburring tool according to claim 14, wherein said leaf springs are formed integrally with said housing.

* * * * *